United States Patent [19]

Aragona

[11] 4,364,558

[45] Dec. 21, 1982

[54] PUNCHING BAG APPARATUS AND SUPPORTING MEANS THEREFORE

[76] Inventor: Louis Aragona, 11 Scheiber Ter., Cedar Grove, N.J. 07009

[21] Appl. No.: 249,344

[22] Filed: Mar. 31, 1981

[51] Int. Cl.[3] ..... A63B 69/22

[52] U.S. Cl. ..... 272/78; 248/95; 248/318; 272/900

[58] Field of Search ..... 272/78, 76, 77, 900; 273/55 R, 55 A; 248/95, 96, 101, 318

[56] References Cited

U.S. PATENT DOCUMENTS

| | | | |
|---|---|---|---|
| 774,184 | 11/1874 | Keith | 273/78 |
| 1,538,203 | 5/1925 | Moran | 273/55 |
| 2,210,024 | 8/1940 | Cayo | 273/77 |
| 4,050,693 | 9/1977 | Lichterman | 273/78 |

*Primary Examiner*—Richard C. Pinkham
*Assistant Examiner*—T. Brown
*Attorney, Agent, or Firm*—Anthony F. Cuoco

[57] ABSTRACT

The apparatus disclosed includes a punching bag member (2) having a body portion (4) and a neck portion (6). A supporting member (8) engages the neck portion (6) for supporting the punching bag member (2) between a pair of vertical members such as in a door frame (10) or the like. The arrangement is such that supporting member (8) engages brackets (12) on the vertical members and supports the punching bag member (2) so that it offers resistance to the user when body portion (4) is struck and automatically returns to its normal position.

5 Claims, 9 Drawing Figures

PUNCHING BAG APPARATUS AND SUPPORTING MEANS THEREFORE

BACKGROUND OF THE INVENTION

Punching bags are generally constructed of an expensive leather exterior which covers an inflated rubber bladder. These bags require special attachments which are inserted into a swivel hook bag holder permanently affixed to a platform or the like from which the bag is suspended. Apparatus of this type is expensive and is directed toward the experienced user.

A need exists for a punching bag type member and support means therefor directed toward the inexperienced user and featuring simplified construction. U.S. Pat. No. 3,813,095 issued on May 28, 1974 to Leo E. Long attempts to accomplish this purpose by providing punching bag apparatus which may be suspended on a bar in a door frame or between two vertical members, as the case may be. However, this device requires an elaborate spring return mechanism for the punching bag and in this sense the simplicity of the apparatus is compromised.

Accordingly, it is an object of the present invention to provide punching bag type apparatus and supporting means particularly directed to the inexperienced user which is economical in construction and simple to install, and hence represents an improvement over like apparatus now known in the art.

BACKGROUND OF THE INVENTION

This invention contemplates punching bag type apparatus and means for supporting the apparatus between a pair of vertical members such as in a door frame or the like. A punching bag type member which may be molded or otherwise fabricated of a suitable plastic material so as to form a substantially hollow member has a body portion which is struck by the user and a neck portion which is adapted to engage a supporting member which may be a pair of wires or other suitably resilient members twisted together for providing a resilient open central portion for engaging the punching bag type member and extending therefrom on both sides thereof. The supporting member is adapted at its ends for being supported between the vertical members by suitable brackets or the like. The arrangement is such that the supporting member supports the punching bag type member, whereby resistance is offered to the user when the body of the member is struck, and the member automatically returns to its normal position when the striking is discontinued.

BRIEF DESCRIPTION OF THE DRAWINGS

FIG. 8 is a front plan view of a bracket for receiving the supporting means as shown in FIGS. 4 and 7, and whereby the bag is supported between vertical members such as in a door frame or the like.

DETAILED DESCRIPTION OF THE INVENTION

Figure 1:
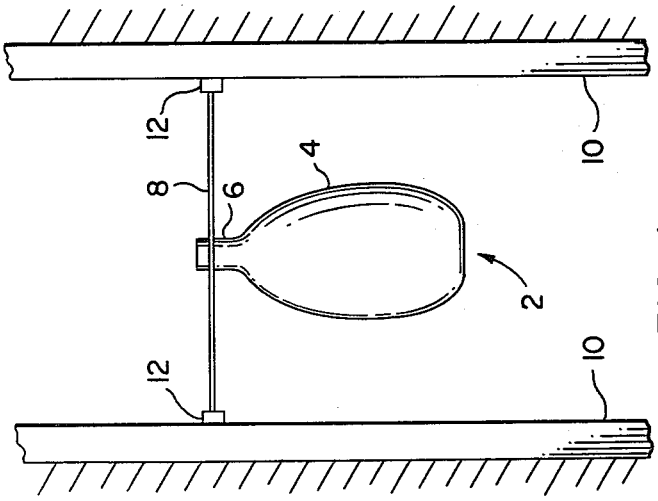
FIG. 1 is a diagrammatic representation of punching bag type apparatus and supporting means according to the invention.

With reference first to FIG. 1, the invention disclosed includes a punching bag type member designated generally by the numeral 2 and including a body portion 4 and a neck portion 6. Punching bag type member 2 may be molded or otherwise fabricated from a suitable, thin gauge plastic material such as polyethylene or the like for providing a relatively rigid hollow member. In these respects member 2 is not unlike commercially available plastic containers which contain soft drinks and other liquids for sale to the consumer.

Neck portion 6 of punching bag member 2 is supported by a supporting member 8 so that the bag member extends substantially normal to the supporting member and substantially central thereto. Supporting member 8 extends from neck portion 6 in opposite directions and is received by brackets or the like 12 secured at the opposite sides of a door frame 10.

In this connection it is noted that the invention is described as being supported in a door frame, but it will be understood that the support means can be a pair of vertical members in substantially parallel relation to each other, as the case may be.

Figure 3:
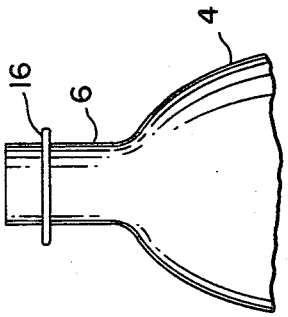
FIG. 3 is a diagrammatic representation of another embodiment of the invention, wherein the neck portion of the punching bag type member has a flange for engaging the supporting means.
Figure 2:
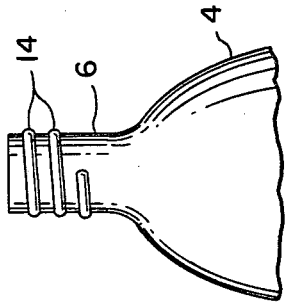
FIG. 2 is a diagrammatic representation showing one embodiment of the invention, wherein the neck portion of a punching bag type member shown in FIG. 1 has protrusions thereon for engaging the supporting means.

Neck portion 6 of punching bag type member 4 is adapted for receiving supporting member 8 as shown with reference to FIGS. 2 and 3. Supporting member 8 is specifically shown in FIG. 4.

Thus, with reference to FIG. 2, neck portion 6 of member 4 is seen as having a plurality of protrusions 14 extending circumferentially around the neck, and in this regard the neck portion resembles the neck portion of the aforenoted liquid containers, whereby a cap is screwed on to the extending protrusions or threads to close and seal the containers.

With reference to FIG. 3, neck portion 6 of punching bag type member 4 is seen as including a flange 16 disposed substantially below the top of the neck and extending circumferentially therearound.

Figure 4:
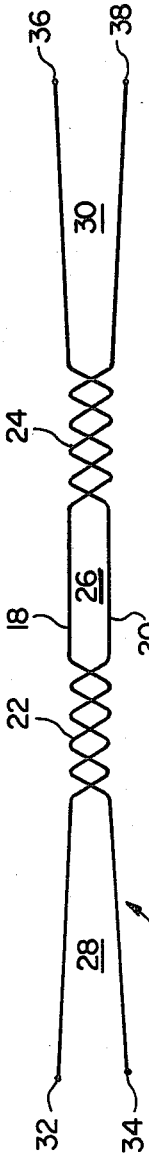
FIG. 4 is a top view diagrammatic representation of supporting means for the punching bag type member according to the invention.
Figure 7:
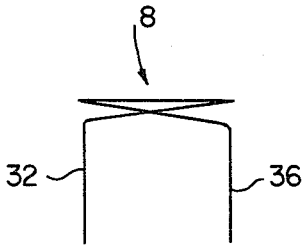
FIG. 7 is an end view of the supporting means, the top view of which is shown in FIG. 4.

With reference to FIG. 4, supporting member 8 is seen as including a pair of resilient members 18 and 20, and which members may be wires of a suitable gauge and material so as to have the appropriate resiliency for purposes which will hereinafter become evident. Wires 18 and 20 are arranged so that they are twisted together to form a unitary member at 22 and 24, with the wires being in spaced relation at their central portion 26; at an end portion 28 extending in one direction beyond twisted portion 22; and at the opposite end portion 30 extending in the opposite direction beyond twisted portion 24. The wires terminate at ends 32, 34 and 36, 38, and which ends may be bent substantially normal to the extending portions of the wires as shown in FIG. 7.

Thus, with continued reference to FIG. 4, central portion 26 of supporting member 8 coacts with protrusions 14 on neck portion 6 as shown in FIG. 2, or with flange 16 as shown in FIG. 3 to support punching bag type member 2, and ends 32, 34, 36 and 38, are received by brackets 12 for supporting the arrangement in door frame 10 as shown in FIG. 1.

Figure 5:
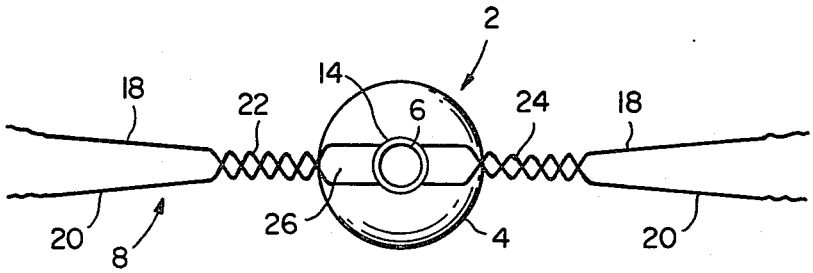
FIG. 5 is a top view diagrammatic representation showing the neck portion of the punching bag type member in accordance with FIG. 2 engaging the supporting means as shown in FIG. 4.
Figure 6:
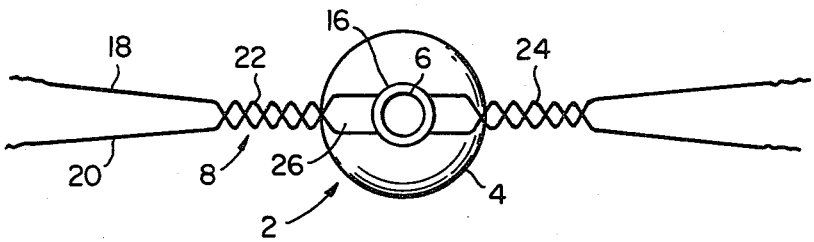
FIG. 6 is a top view diagrammatic representation showing the neck portion of the punching bag type member in accordance with FIG. 3 engaging the supporting means as shown in FIG. 4.

With reference to FIGS. 5 and 6, central portion 26 of supporting member 8 may be spread apart either by the fingers of a user or with an appropriate tool such as a screw driver or the like. Thereafter, the central portion is slipped over protrusions 14 (FIG. 2) or flange 16 (FIG. 3), after which the two wires 18 and 20 forming central portion 26 are released so as to snap under the protrusions or the flange as the case may be, whereby punching bag type member 4 is supported with its axis substantially normal to the axis of supporting means 8 when the member is at a level or horizontal position as shown in FIG. 1.

Figure 8:
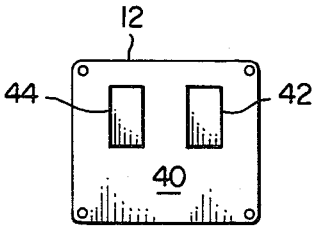
Figure 9:
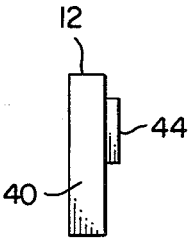
FIG. 9 is an end view of the bracket shown in FIG. 8.

Brackets 12, which may be in the form shown in FIGS. 8 and 9, have a base 40 and a pair of pockets 42 and 44, and which pockets 42 and 44 receive ends 32, 34 and 36, 38 of supporting member 8 so as to support the supporting member within door frame 10. Brackets 12 for this purpose may be of a metallic or plastic material as will now be understood by those skilled in the art.

Thus, with punching bag member 2 supported by supporting means 8 and supporting means 8 supported in door frame 10 as heretofore described, when body 4 of punching bag type member 2 is struck by the user the bag acts much like a conventional punching bag, and when the striking ceases it quickly returns to its normal rest position. Moreover, the punching bag is simple to install and can be installed in a variety of places without elaborate structure required for this purpose.

Due to the nature of supporting member 8, wire members 18 and 20 included therein may be of indeterminable length, and their ends may be bent at right angles to their extending portions by the user as shown in FIG. 7 to accommodate various door frame widths as the case may be. Further the supporting means does not require an elaborate mechanism for accomplishing the purposes intended, as has been the case with other punching bag type equipment for like purposes.

Moreover, the resiliency of wire members 18 and 20 may vary, depending upon the strength and age of the user so that more or less resistance is provided when the bag type member is struck as will be understood by those skilled in the art.

The punching bag arrangement as heretofore described is useful in developing special skills in the boxing arts and developing hand and eye coordination, and hence may be readily adapted to a physical fitness, physical therapy or rehabilitation program as the case may be. The punching bag type apparatus disclosed is not intended to replace the conventional punching bag and platform employed by professionals, but is rather intended to provide an economical and simple device to serve the purposes aforenoted.

Having thus described the invention, what is claimed is:

1. Punching bag apparatus and supporting means therefor, comprising:

a punching bag member having a body portion adapted for being struck by a user and a neck portion adapted for engaging a supporting member;

the supporting member including a pair of elongated wire-like members which are twisted at opposite ends so that said wire-like members are unitary, with the twistings on one end being in spaced relation with the twistings on the opposite end to form a centrally disposed resilient portion for engaging the neck portion of the punching bag member so that said member offers resistance when the body portion thereof is struck by the user and automatically snaps back to the rest position, said elongated wire-like members having portions extending in opposite directions from the centrally disposed resilient portion; and the portions of the supporting member extending in opposite directions from the centrally disposed resilient portion being adapted at their ends for being mounted on a supporting structure.

2. Punching bag apparatus and supporting means therefore as described by claim 1, wherein the neck portion of the punching bag member adapted for engaging a supporting member includes:

the neck portion having protrusions extending externally therearound; and the supporting member coacting with the neck portion so that said neck portion snaps into the centrally disposed resilient portion when the elongated wire-like members are forced apart at the centrally disposed resilient portion to provide an opening for the neck portion, and the portions of the elongated wire-like members forming said opening being retained by the external protrusions.

3. Punching bag apparatus and supporting means therefor as described by claim 1, wherein the neck portion of the punching bag member adapted for engaging a supporting member includes:

the neck portion having a flange extending externally therearound; and the supporting member coacting with the neck portion so that said neck portion snaps into the centrally disposed resilient portion when the elongated wire-like members are forced apart at the centrally disposed resilient portion to provide an opening for the neck portion, and the portions of the elongated wire-like resilient members forming said opening being retained by the flange.

4. Punching bag apparatus and supporting means therefor as described by claim 1, wherein:

each of the pair of elongated wire-like members extends beyond the twistings in opposite directions from the centrally disposed portion;

the ends of the elongated wire-like members are substantially normal to the extending members; and the supporting structure carries means for receiving said ends so that the supporting means supports the punching bag member on the supporting structure.

5. Punching bag type apparatus and supporting means therefor as described by claim 1, wherein:

the punching bag type member is a hollow, relatively rigid container like member.

* * * * *